US005249686A

United States Patent [19]

Brookman et al.

[11] Patent Number: 5,249,686

[45] Date of Patent: Oct. 5, 1993

[54] SHIPPING CASE AND INSERT FOR AUTOMATED BOX BLANK HANDLING SYSTEM

[75] Inventors: Donald L. Brookman, Richmond; Everett C. Grollimund; Gary E. Grollimund, both of Midlothian; Steven F. Spiers, Richmond, all of Va.

[73] Assignee: Philip Morris Incorporated, New York, N.Y.

[21] Appl. No.: 806,691

[22] Filed: Dec. 12, 1991

[51] Int. Cl.[5] ..... B65B 43/00

[52] U.S. Cl. ..... 206/555; 206/499; 206/814; 229/900; 414/417

[58] Field of Search ..... 229/120, 120.1, DIG. 14, 229/900; 221/279; 414/417; 206/449, 555, 556, 499, 486, 489, 490, 495, 814

[56] References Cited

U.S. PATENT DOCUMENTS

| | | | |
|---|---|---|---|
| 1,032,182 | 7/1912 | Brunnert | 414/417 |
| 1,434,587 | 11/1922 | Broadley . | |
| 1,493,460 | 5/1924 | Pinkerton | 229/120 X |
| 1,751,170 | 3/1930 | Parker | 229/900 X |
| 2,374,177 | 4/1945 | Conner et al. | 229/120 X |
| 2,789,708 | 4/1957 | Payne | 414/417 X |
| 2,856,089 | 10/1958 | Lennon | 414/417 |
| 2,921,702 | 1/1960 | Gross | 214/310 |
| 3,172,534 | 3/1965 | Martin | 206/499 X |
| 3,780,892 | 12/1973 | Frank | 214/152 |
| 3,804,234 | 4/1974 | Gordon | 206/499 X |
| 3,831,835 | 8/1974 | Guhl | 229/900 X |
| 3,844,428 | 10/1974 | Olsen | 414/417 X |
| 3,858,746 | 1/1975 | Hirota | 414/417 X |
| 3,861,576 | 1/1975 | Tolaas et al. | 229/120 X |
| 3,926,323 | 12/1975 | Frank et al. | 214/310 |
| 4,121,752 | 10/1978 | Ravotto et al. | 206/486 |
| 4,279,374 | 7/1981 | Webinger | 229/120 |
| 4,571,141 | 2/1986 | Gieson | 414/417 |
| 4,770,339 | 9/1988 | Weimer | 229/120 X |
| 5,067,303 | 11/1991 | Brookman et al. | 414/417 X |

FOREIGN PATENT DOCUMENTS

| | | | |
|---|---|---|---|
| 1517934 | 3/1968 | France | 229/120 |

*Primary Examiner*—Steven N. Meyers
*Assistant Examiner*—Jacob K. Ackun, Jr.
*Attorney, Agent, or Firm*—Nicola A. Pisano

[57] ABSTRACT

A system is provided for packing, shipping and automated unloading of stacks of box blanks so as to minimize damage to the box blanks and facilitate the insertion of the box blanks into an automated packaging machine. A fitted shipping case, filled with stacks of box blanks and upper and lower inserts, has a plurality of holes in its upper and lower flaps for cooperating with an automated unloading machine. Inserts enclosed in the shipping case minimize damage due to shifting of the box blank stacks, provide added resistance against case failure during transit, and cooperate with the automated unloading machine to facilitate removal of the box blank stacks from the shipping case.

4 Claims, 10 Drawing Sheets

FIG. 9
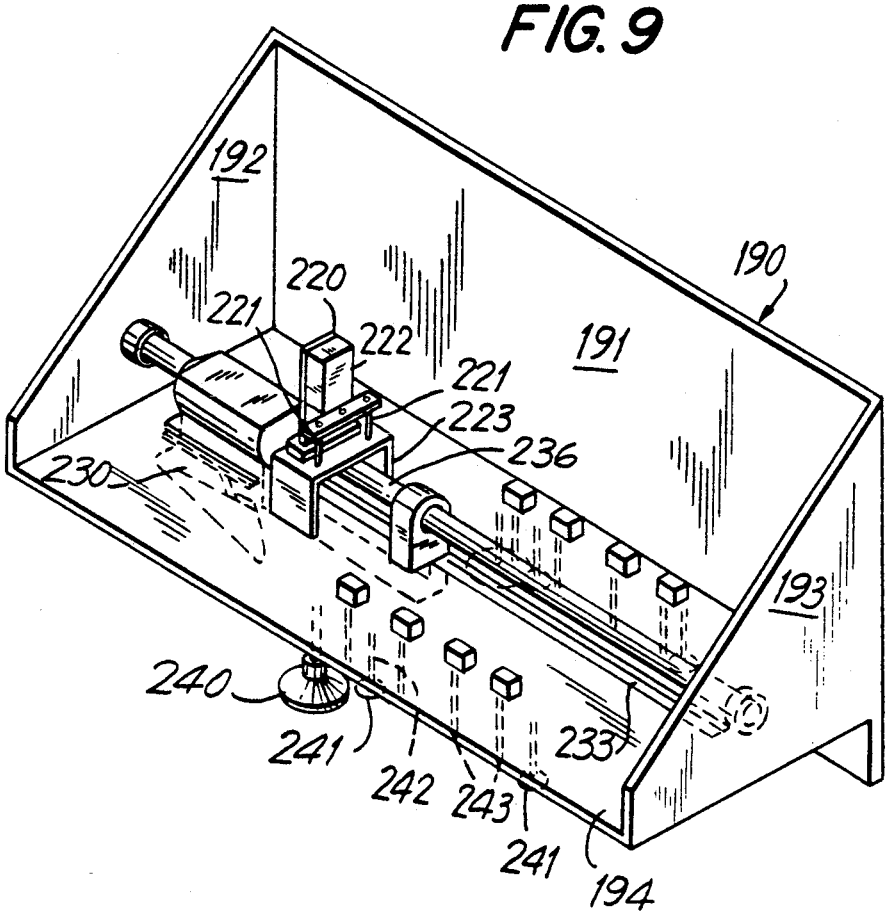
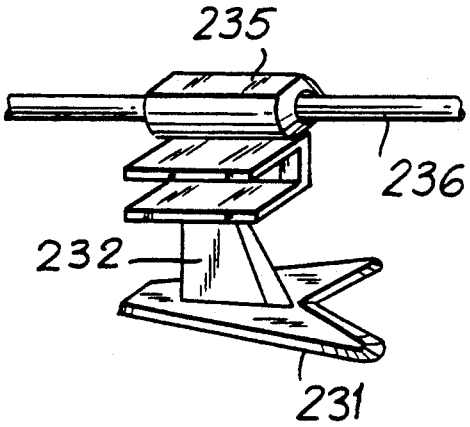
FIG. 10

SHIPPING CASE AND INSERT FOR AUTOMATED BOX BLANK HANDLING SYSTEM

This application is a later filed application of U.S. Pat. application Ser. No. 07/600,437, now U.S. Pat. No. 5,067,303, granted Nov. 26, 1991.

BACKGROUND OF THE INVENTION

This invention relates to means for packing, shipping and automated unloading of stacks of box blanks so as to minimize damage to the box blanks.

A box blank typically consists of a piece of precut cardboard which when loaded into a packaging machine is folded and fastened together by glue or otherwise in a predetermined fashion. Automated packaging systems employing such box blanks are widely used in the packaging of commercial and consumer products, such as breakfast cereals and tobacco products. The box blanks are typically shipped from a point of origin in shipping cases containing, for example, 4000 box blanks, arranged in four stacks of 1000 box blanks per stack. Considerable manual effort is required to open a box blank shipping case, remove a stack of box blanks, and insert the stack into a packaging machine. Apart from the labor intensive nature of the existing method for loading box blanks into the packaging machine, a number of problems arise from these activities.

Conventional packaging machines have a hopper area into which a stack of box blanks is loaded by the machine operator. When the stack of box blanks is depleted, the packaging machine must be idled while the operator procures and loads a new stack of box blanks. As loaded in a standard shipping case, box-blank stacks are generally each about twelve inches high. Since an operator cannot typically handle blocks of box blanks greater than a few inches thick at a time, numerous operations are needed to load the packaging machine hopper. Furthermore, as packaging machine speed increases with the advent of newer models, the time needed to load the hopper with box blanks can become a limiting feature on the packaging system productivity.

Previously known shipping cases suffer from a number of drawbacks. Chief among these is that significant clearance must be provided on either side of the box blank stacks contained within a shipping case to permit the packaging machine operator to reach into the box alongside the stacks to remove portions of a stack. Lateral shifting of the box blanks during transit can occur when portions of the box blank stacks shift sideways into the clearance on the side faces of the box blank stacks. As a result of such sideways shifting, the finish on the box blank, including printing or decorative designs, can become marred, thereby producing an unacceptable final product.

Since methods of determining how many box blanks are placed in each stack are generally imprecise, it frequently occurs in previously known shipping cases that some axial movement of the uppermost box blanks in each stack results. Such movement at the box blank stack ends can further exacerbate lateral shifting or interleaving, thereby damaging the end blanks by bending or marring. Such movement also necessitates manual effort to realign the stack before it can be loaded into the packaging machine hopper. Additional downtime and effort may be required to cull out damaged blanks prior to loading the packaging machine.

Alternatively, when damaged box blanks are not sufficiently culled from the stacks loaded into the packaging machine hopper, distorted blanks may result in misfeeding or jamming of the packaging machine. Considerable expense and downtime may be occasioned by the need to interrupt the packaging machine operation to retrieve damaged box blanks.

It is an object of this invention to provide a shipping case, suitable for automated unloading, which restrains axial movement and lateral interleaving of the box blanks at the stack ends during transit of the shipping case from the point of origin to the point of use.

It is another object of this invention to provide a shipping case, suitable for automated unloading, which minimizes lateral shifting of the box blanks into the clearances provided at the sides of the box to aid manual removal, which shifting occurs due to vibrations induced during shipping and handling of the shipping case.

It is a further object of this invention to provide a shipping case inset, suitable for use in an automated shipping case unloading system, wherein the insert has tabs which when inserted in between the stacks of box blanks restrain axial shifting and lateral interleaving of the box blanks at the stack ends and which supports the shipping case to resist case failure.

It yet another object of this invention to provide a shipping case and shipping case insert which facilitate an automated shipping case unloading procedure, so that the stacks of box blanks may be unloaded from the shipping case with a minimum of operator intervention.

It is still another object of this invention to provide an automated system which opens shipping cases containing stacks of box blanks and lifts the stacks out of the shipping case, conveniently presenting such stacks for manual or automated loading into the packaging machine hopper with a minimum of operator intervention.

SUMMARY OF THE INVENTION

In view of the foregoing, it is an object of this invention to provide a shipping case and shipping case insert, suitable for use in an automated unloading apparatus, which case and insert are designed for shipping stacks of box blanks, so that the box blanks sustain a minimum of damage during transit. It is a further object of this invention to provide a machine that opens a shipping case containing stacks of box blanks, unloads the stacks of box blanks from the shipping case and presents the stacks of box blanks to the human operator in a manner facilitating loading into a conventional packaging machine.

The shipping case of the present invention is sized to fit snugly around a group of stacks of box blanks with a minimum of clearance between the sides of the stacks of box blanks and the shipping case sidewalls. By minimizing this clearance, the potential for lateral travel or shifting of the box blanks within a stack is reduced, thus the potential for marring of the box blank finish is mitigated. Another important feature of the fitted shipping case of the present invention is that there is only a minimum clearance at the ends of the box blank stacks, so that axial movement of the stacks is reduced or eliminated.

The shipping case insert constructed in accordance with the present invention comprises a piece of heavy stock paper or corrugated paper board approximately the size of the shipping case top area, and having a plurality of downwardly extending tabs projecting from the perimeter of the insert. In accordance with this invention, the tabs project downward into voids alongside the box blank stacks, and restrain the box blanks from lateral motion induced by vibration during transit of the shipping case.

The fitted shipping case and insert intended for use with automated box blank unloading apparatus each have a plurality of holes or star-shaped cuts at predetermined locations, which holes or cuts cooperate with the box blank handling machine to facilitate unloading of the shipping case.

In the automated shipping case unloading machine constructed in accordance with this invention, a shipping case containing stacks of box blanks is received from a conventional box transport system, for example a conveyor belt system. The shipping case is gripped by a first portion of the machine while a second portion of the machine is positioned atop the shipping case and the adhesive tape securing the upper flaps of the shipping case is severed. After opening the upper flaps of the shipping case, the second portion of the apparatus moves to a position remote from the shipping case.

A third portion of the machine is then moved into a position so that its vertically upward projecting members pass through pre-cut holes or star cuts in the shipping case base, and contact the bottom box blank in a stack. The third portion of the machine moves upwards so that its vertically upward projecting members extend through the shipping case base and carry the stack of box blanks to a position above and clear of the vertical walls of the shipping case.

Once the packaging machine operator has removed a stack of box blanks from atop the vertical members of the third portion of the machine, the third portion of the machine is lowered, causing the vertical members to retract through the holes in the shipping case base. The above described procedure is repeated for each of the remaining stacks of box blanks contained in the shipping case.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which:

FIG. 9 is a partially fragmentary perspective view of the shipping case opening hood;

FIG. 10 is a partial elevation view of the shipping case opening means.

DESCRIPTION OF THE PREFERRED EMBODIMENT

Figure 1:
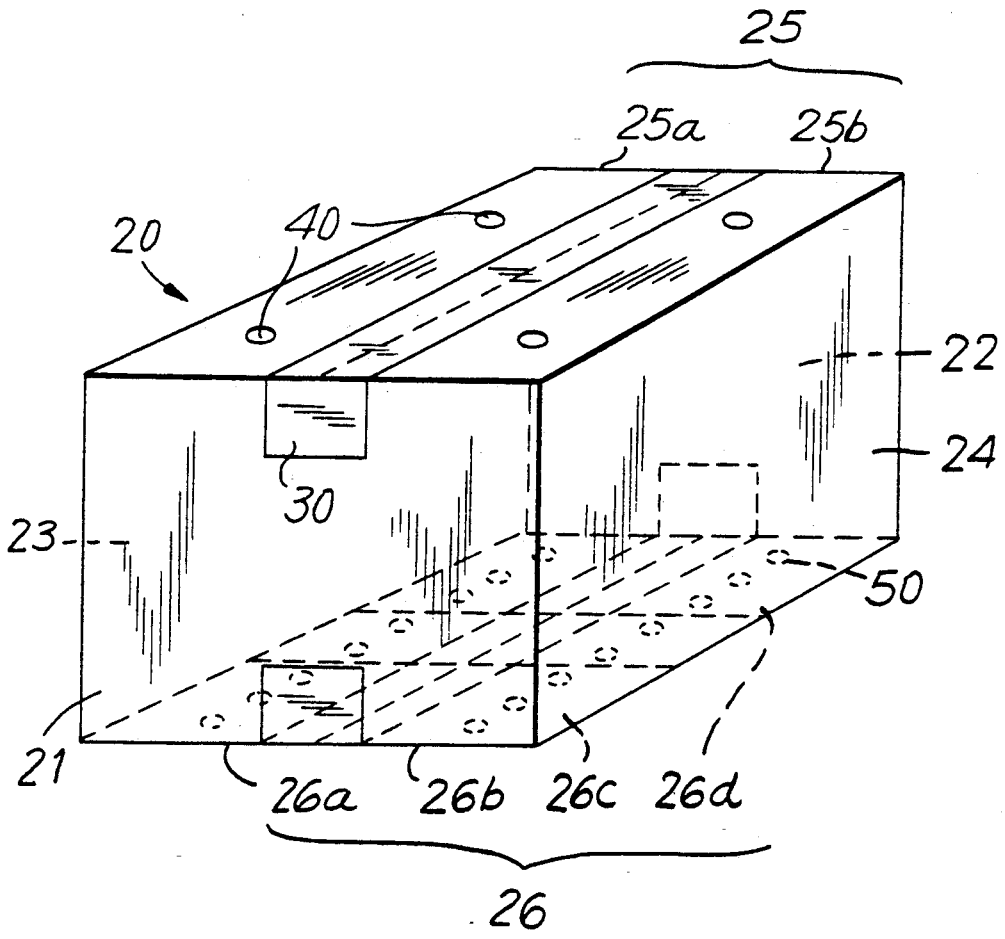
FIG. 1 is a perspective view of the fitted shipping case for use with an automated box blank handling apparatus.

In FIG. 1 there is shown a shipping case, generally designated 20, constructed in accordance with a preferred embodiment of the present invention. Shipping case 20 is generally rectangular in shape, having opposing end walls 21, 22, opposing side walls 23 and 24 and top 25 and bottom 26. Top 25 is comprised of two flaps 25*a* and 25*b*, while bottom 26 is comprised of four bottom flaps 26*a–d*. The pairs of side walls 21 and 22 and end walls 23 and 24 are joined along the vertical edges. Top flaps 25*a* and 25*b* are joined to side walls 23 and 24 respectively along the uppermost horizontal edges of the respective side walls. Inner bottom flaps 26*c* and 26*d* are joined to end walls 21, 22 and outer bottom flaps 26*a* and 26*b* are joined to side walls 23 and 24 along the lowermost horizontal edges of the end walls and side walls, respectively. Tape strip 30 seals the adjacent edges of the top flaps 25*a*, 25*b* and the bottom flaps 26*a*, 26*b* to close the shipping case 20. Top flaps 25 have a hole 40 about one inch in diameter near each of the corners sealed by tape strip 30. Bottom flaps 26 have a plurality of holes 50 therethrough, which holes are located transversely the width and length of flaps 16 for cooperating with the automated unloading machine as hereinafter described.

An important feature of the fitted shipping case resides in dimensioning the shipping case to fit snugly around the desired number of stacks of box blanks. Whereas in previously known shipping cases there was permitted in excess of one inch of clearance at either end of the stacks of box blanks to permit the packaging machine operator to reach into the shipping case, a case constructed in accordance with the present invention requires no more than one-sixteenth (1/16) of an inch clearance on either side of the stacks of box blanks.

Figure 2:
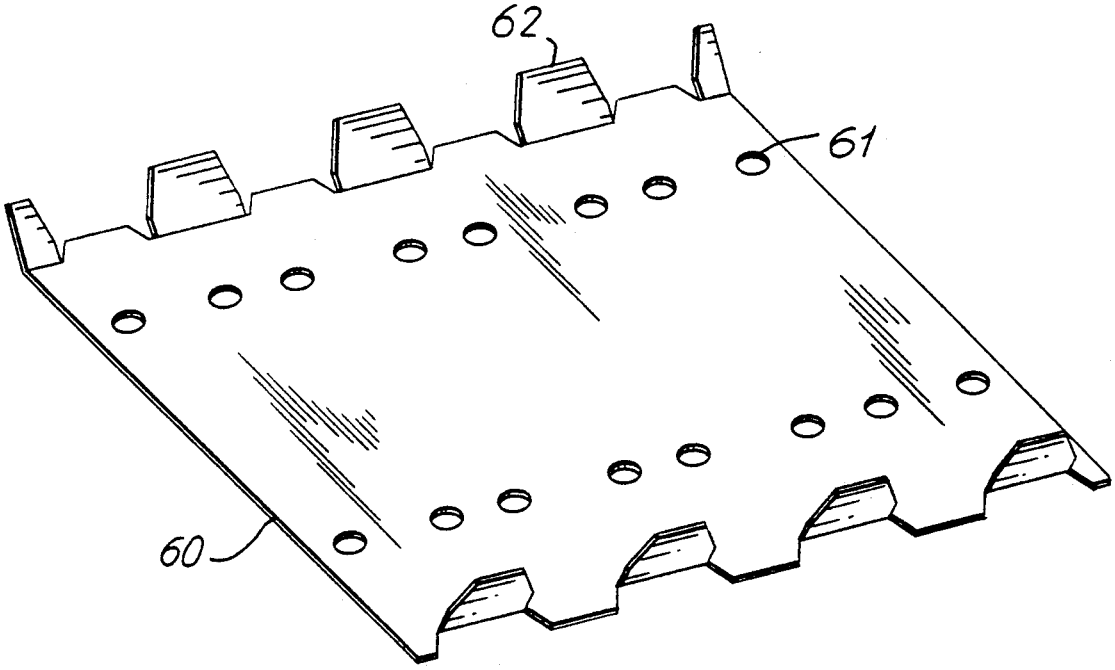
FIG. 2 is a perspective view of a shipping case insert for use with an automated box blank handling apparatus.
Figure 3:
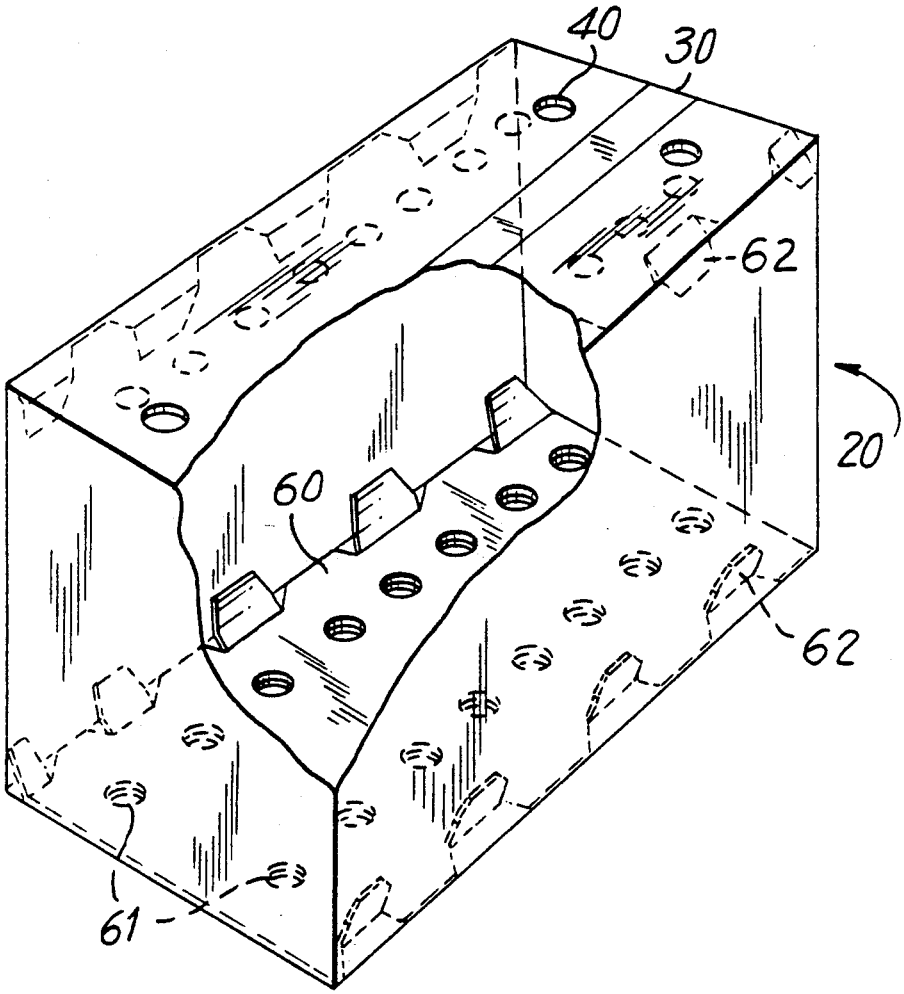
FIG. 3 is a partially fragmentary perspective view of shipping case inserts installed in a fitted shipping case.

Referring to FIGS. 2 and 3, there is shown a shipping case insert 60 constructed in accordance with the present invention. The insert is comprised of a panel of cardboard, corrugated paper board, plastic or other suitable material having dimensions slightly less than the width and length of shipping case 20. Insert 60 has two columns of a plurality of colinear holes 61 located at a position approximately one-quarter of the width of the shipping case inward along the length of the insert. The holes 61 are so positioned as to be colinear in rows across the width of insert 60 so that when insert 60 is positioned in shipping case 20, the holes 61 in insert 60 are aligned with the holes or star-cuts in the bottom flaps 26 of shipping case 20, as shown in FIG. 3.

Figure 4:
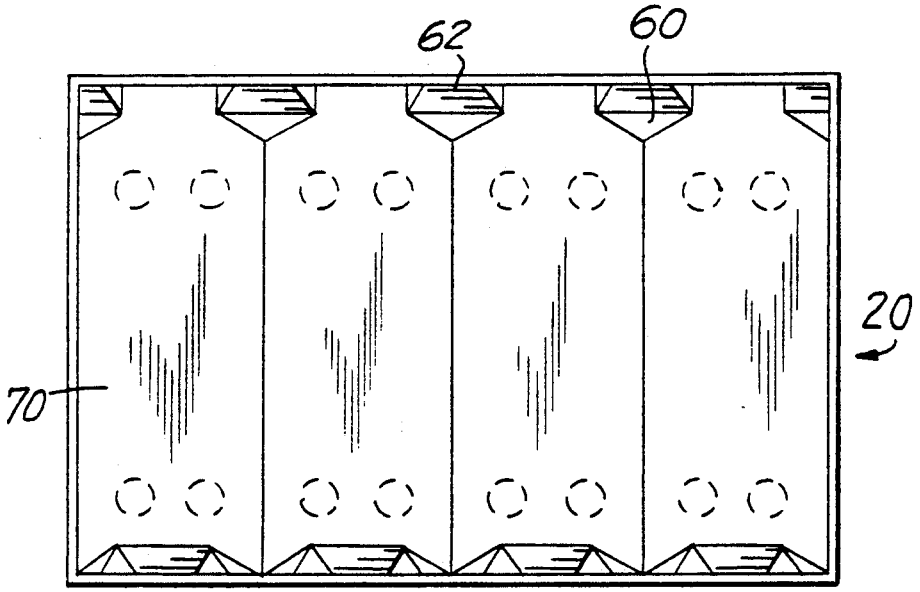
FIG. 4 is a plan view of box blanks positioned in a shipping case upon an insert.

Referring to FIG. 4, insert 60 has a plurality of bendable tabs 62 located along opposing horizontal edges of insert 60. Tabs 62 are intended to extend between the precut notches in box blanks 70 to restrain the stacks of box blanks 70 from shifting during transit. Insert 60 is designed for use interchangeably at the bottom or top of the stacks of box blanks. As shown in FIGS. 3 and 4, tabs 62 may be bent to extend upward from the bottom insert (and downward from the top insert) into the spaces between box blanks 70 to achieve the desired restraint.

In addition, insert 60 can be used to impose a compressive load on the stacks of box blanks 70 by slightly overfilling the shipping case. Thus, when an upper insert 60 is inserted and the top flaps 25 sealed, the compressive load on the stacks of box blanks 70 restrains axial movement of the uppermost box blanks.

Figure 5:
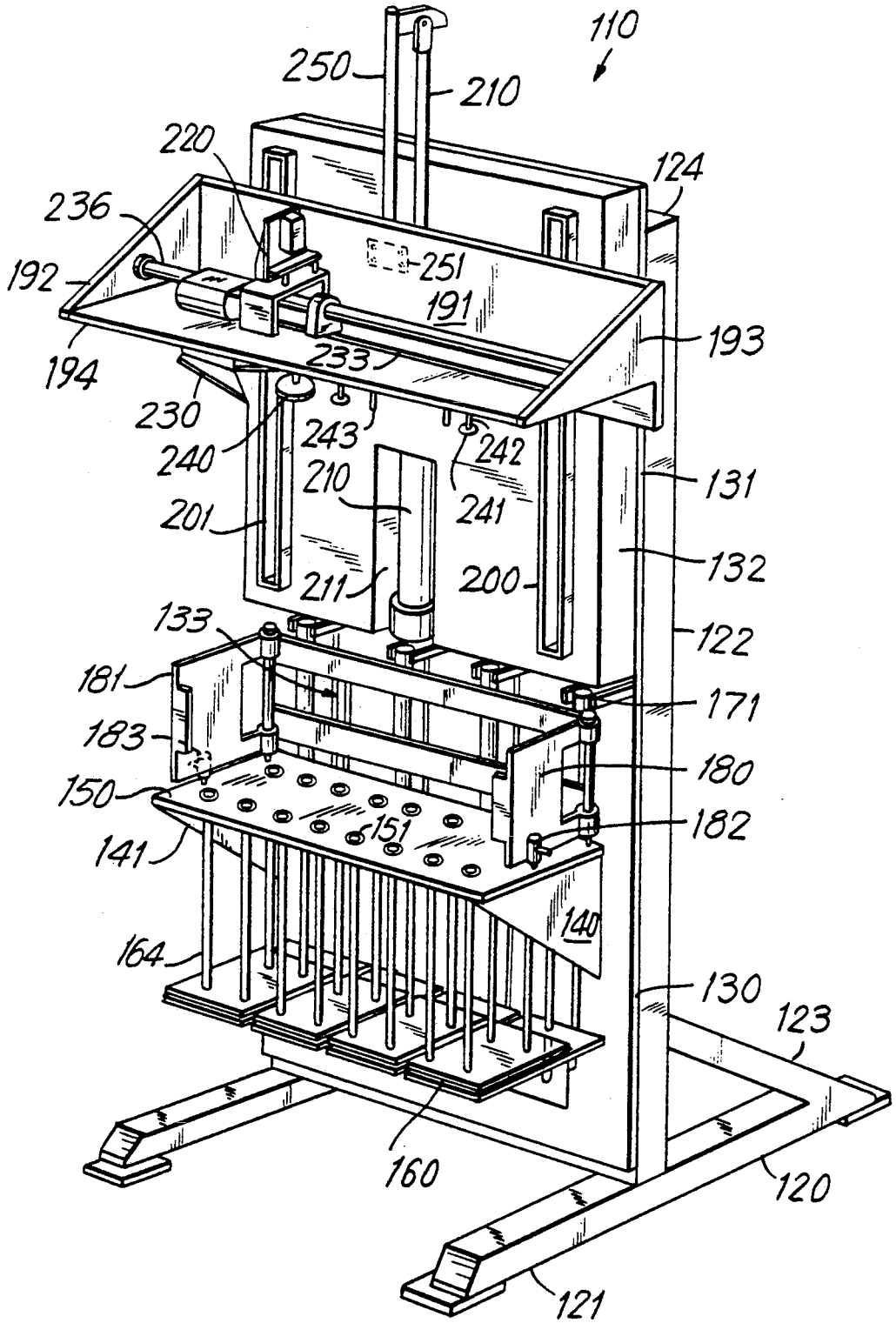
FIG. 5 is an perspective view of the box blank unloading machine.
Figure 6:
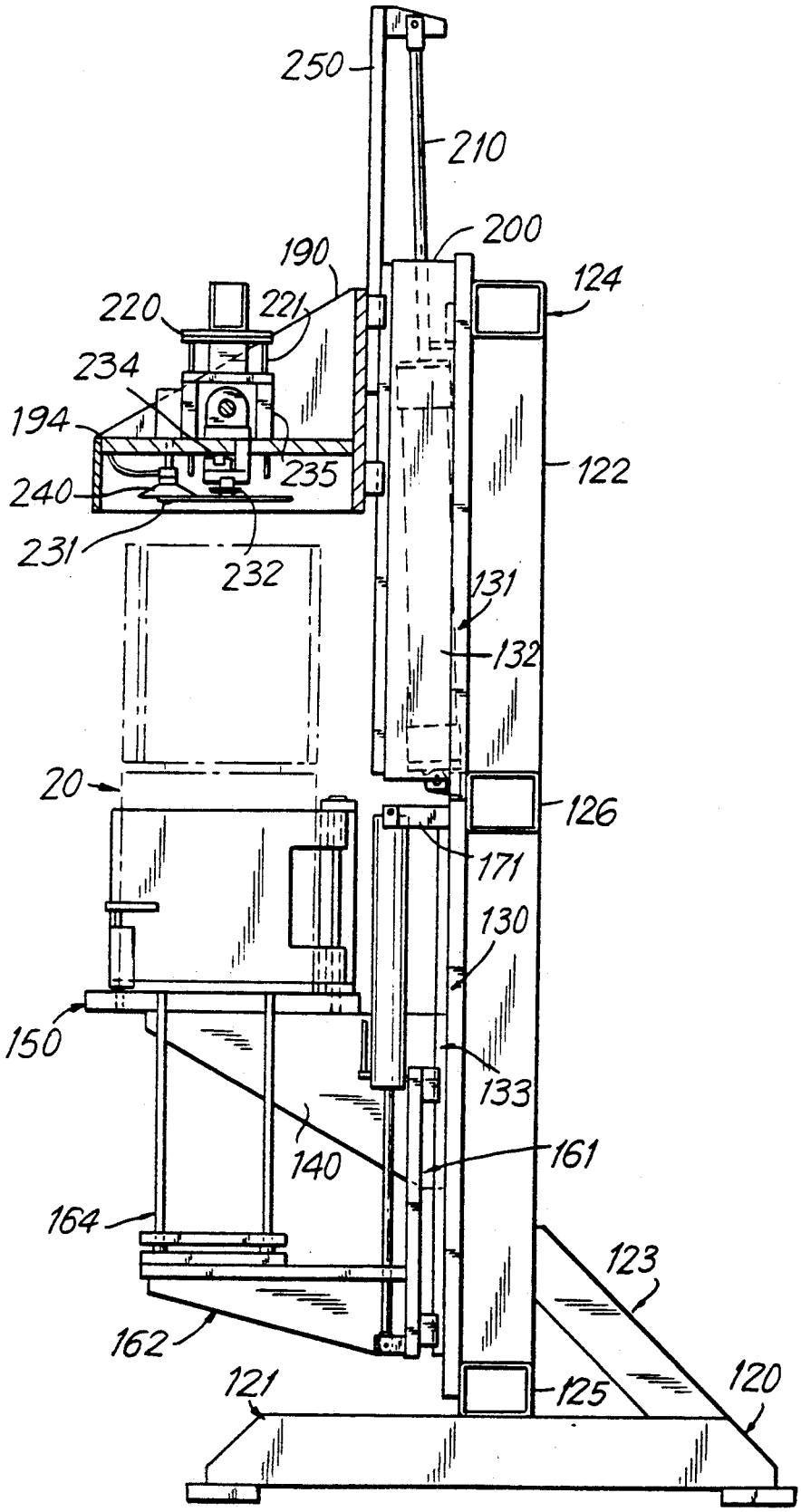
FIG. 6 is an elevation side view of the box blank unloading machine of FIG. 5.

Referring now to FIGS. 5 and 6, there is shown therein a perspective view of a machine 110 which is constructed in accordance with a preferred embodiment of the invention. As shown in FIG. 5, machine 110 includes a base 120 having a forwardly extending legs 121. Preferably, base 120 and legs 121 are mounted on wheels whereby machine 110 may be moved and then fixed in position.

Extending upwardly from and fixedly secured to base 110 are frame members 122. Associated therewith are frame support members 123. At the top of machine 110, a cross-member 124 joins upwardly extending members 122. Fixedly mounted within the upwardly extending frame members 122 are two cross-members 125 and 126. Fixedly mounted to the front of the upwardly extending frame comprised of members 123, 124, 125 and 126 are lower device support plate 130 and upper device support plate 131. Upper device mounting block 132 is fixed to the front surface of upper device support plate 131. Vertically oriented horizontal shipping case support plate members 140, 141 are fixedly mounted to the front of lower device support plate 30. Horizontal shipping case support plate 150 is fixedly mounted to the vertically oriented support members 140, 141 at its narrow ends, and spaced apart from lower device support plate 130, leaving a clearance between horizontal shipping case support plate 150 and lower device support plate 130. Horizontal shipping case support plate 150 includes holes 151 aligned with lifting bars 164 described in detail below.

Figure 7:
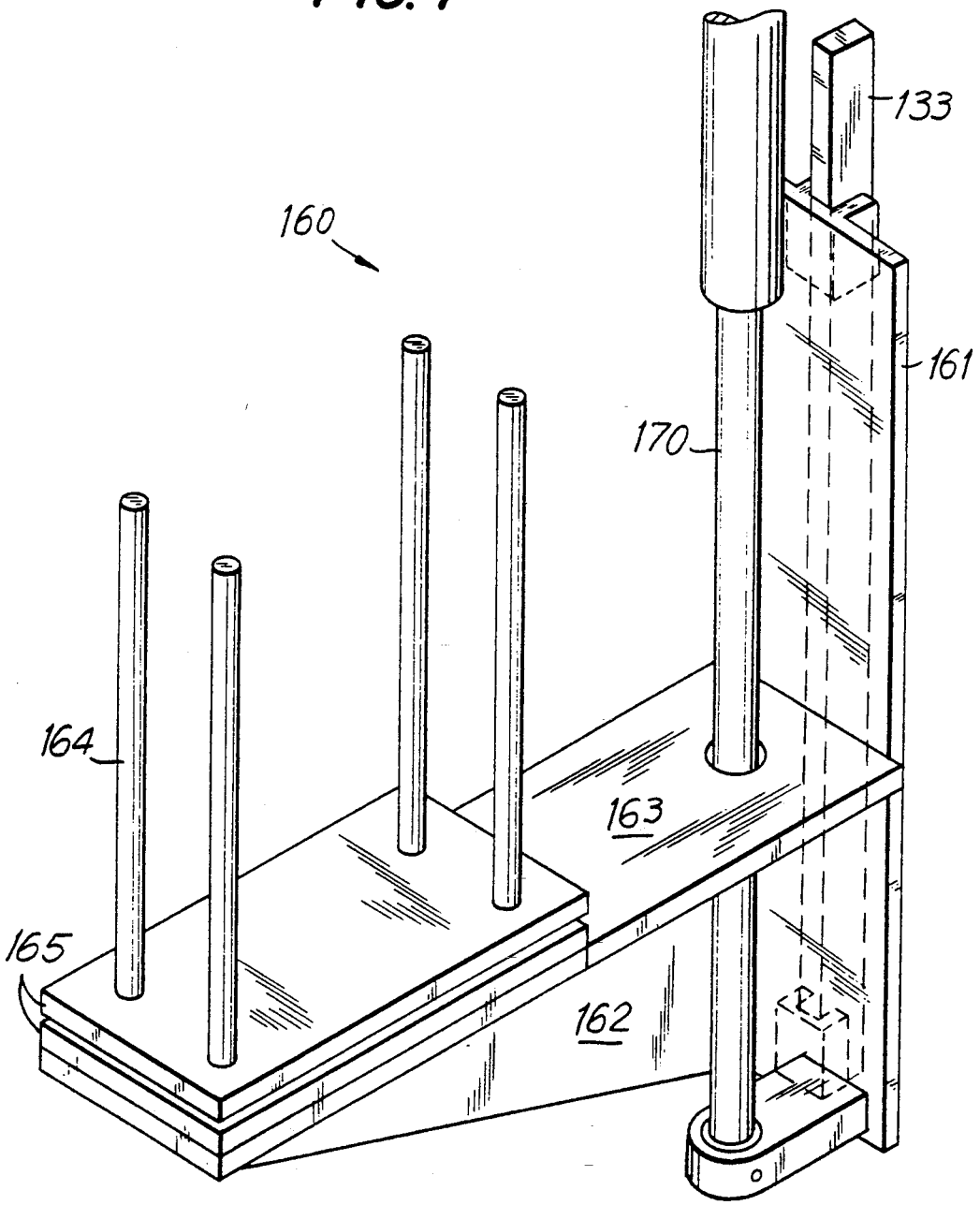
FIG. 7 is a partially fragmentary perspective view of the lifting bar carriage assembly and the rod of its associated driving cylinder.
Figure 11:
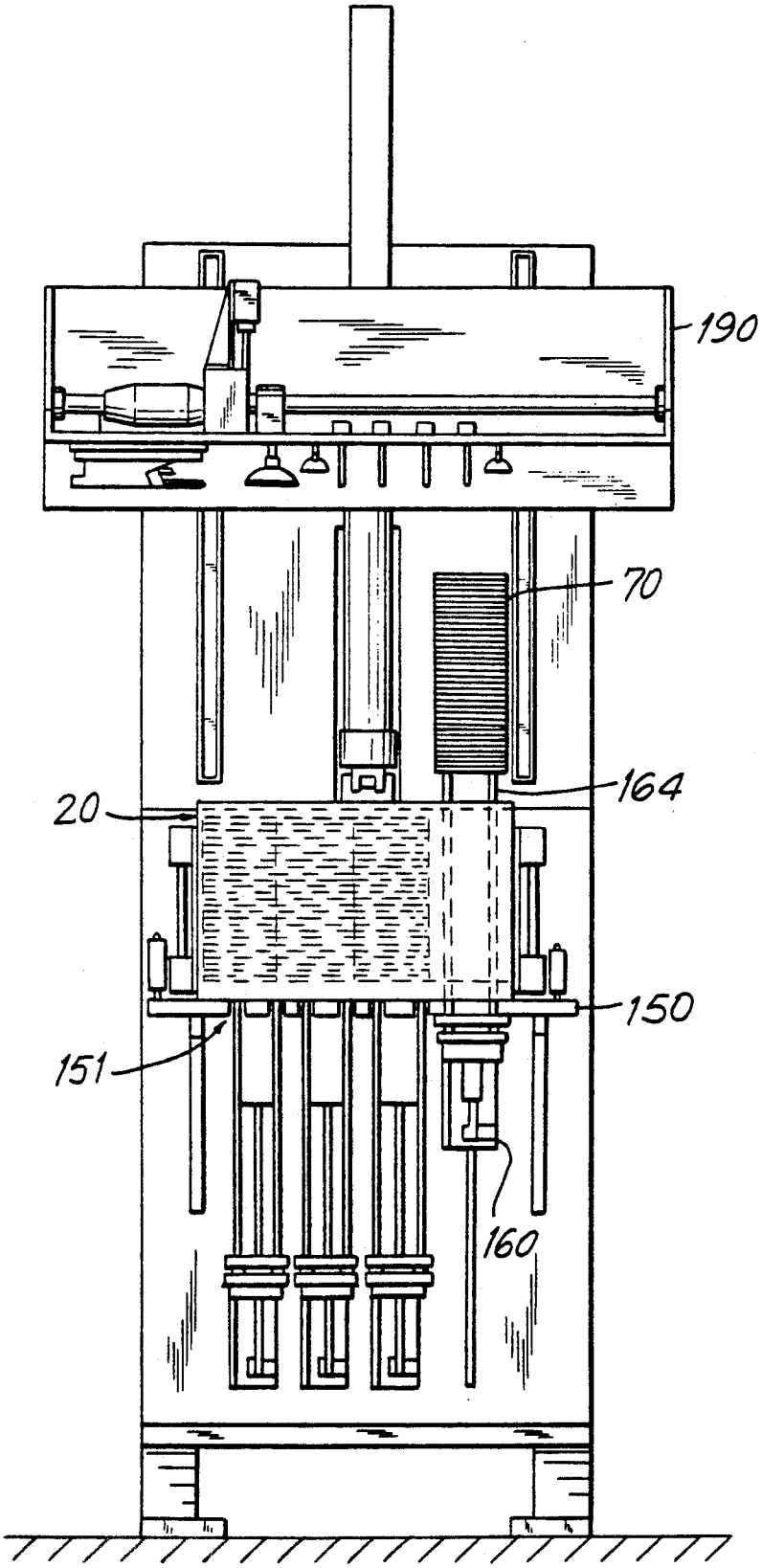
FIG. 11 is a front elevation view of the box blank unloading machine shown in FIG. 5, illustrating the operation of the lifting bar carriage assembly.

Since box blank shipping case 20 typically contains four stacks of box blanks 70 arranged side-by-side in the case, the box blank handling machine described herein includes four lifting bar carriage assemblies, generally designated 160 in FIGS. 5, 6 and 7, one assembly for each box blank stack. Lifting bar carriage assembly 160 is comprised of a vertically oriented guide member 161, slidably engaged on rail 133, which is fixedly secured to the front of lower device support plate 130, permitting sliding movement of guide member 161 in the vertical plane. Lifting bar carriage vertical support member 162 is fixedly secured to guide member 161, and lifting bar carriage horizontal support member 163 is fixedly secured atop vertical support member 162. Four lifting bars 164 are vertically fixedly secured atop the carriage horizontal support member 163 by retaining plates 165 by suitable fasteners, such as bolts or screws. Lifting bar carriage assembly 160 is slideably moveable along rail 133 by pneumatic cylinder 170 which is pivotally mounted at one end by mounting blocks 171 fixedly secured on lower device support plate 130, and pivotally mounted at the other end to vertically oriented lifting bar carriage assembly support member 162. It is to be understood that the rod of cylinder 170 passes through an opening in lifting bar carriage assembly horizontal support member 163 to permit pivotal attachment to guide member 161, for example, by means of a pin. It is also to be understood that the upper portion of cylinder 170 passes through the clearance between horizontal shipping case support plate 150 and lower device support plate 130. As depicted in FIG. 11, during the upward vertical travel of lifting bar carriage assembly 160, lifting bars 164 will pass through the holes 151 in horizontal shipping case support plate 150. Two of the lifting bars 164 along the wider dimension of carriage 160 may be about one-sixteenth (1/16) inch shorter than the bars on the opposing side of carriage 160 so that the stack of box blanks will tilt slightly as it rests upon the lifting bars, thereby facilitating lifting of the stack without interfering with adjacent stacks located in the shipping case.

Referring again to FIGS. 5 and 6, a pair of vertically oriented gates 180, 181 are pivotally mounted to lower device support plate 130 by pin and clevis or other suitable means. Gates 180 and 181 can be moved from a first position in contact with the sides of shipping case 20 to a second position away from the sides of the shipping case, thereby permitting shipping case 20 to be removed from atop support plate 150. When a loaded shipping case 20 has been positioned on support plate 150, gates 180 and 181 are urged against the sides of the shipping case. Locking pins 182, 183, slideably mounted on the outwardly disposed faces of gates 180, 181, are engaged into holes provided in support plate 150, securing shipping case 20 to support plate 150 during the various stages of unloading.

Figure 8:
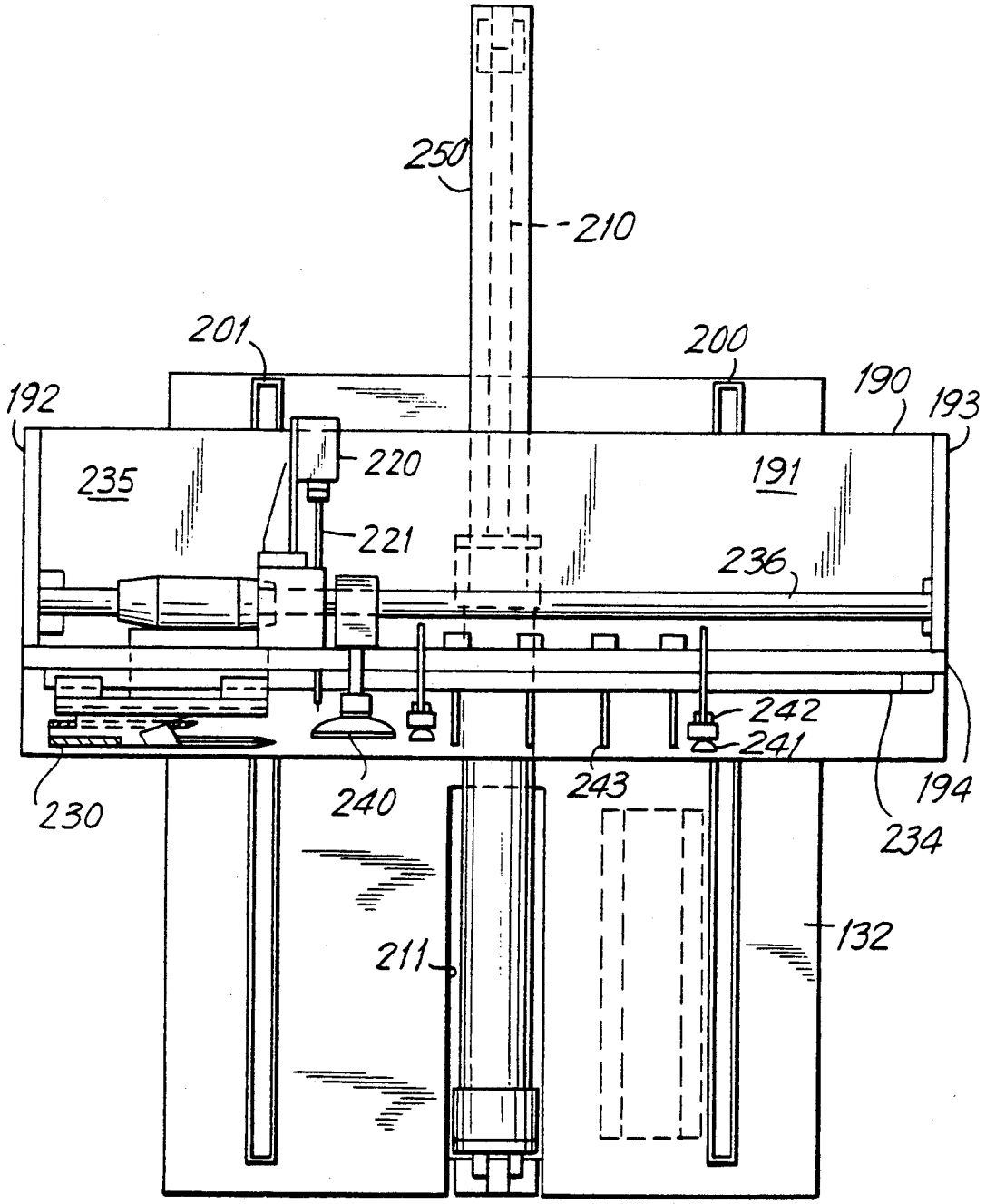
FIG. 8 is a partially fragmentary front elevation view of the upper section of the box blank unloading machine.

Referring to FIGS. 8, 9 and 10, the upper section of box blank handling machine 110 comprises a hood, generally designated 190, which is slideably moveable in the vertical plane along rails 200, 201 by operation of cylinder 210 vertically disposed between the rails 200, 201. The structure of hood 190 includes a vertically disposed back wall 191, and two vertically disposed and spaced apart sidewalls 192 and 193, all of said walls fixedly secured along the adjacent vertical edges. A base plate 194 is fixedly secured in the horizontal plane to the lower edges of walls 191, 192, and 193.

Rails 200 and 201 project outwardly from the front face of upper device mounting block 132 to provide clearance for cylinder 210. Cylinder 210 is pivotally mounted at the lower end to frame cross-member 126 by passing through a slot 211 in upper device mounting block 132 and upper device support plate 131. The upper end of the cylinder 210 is pivotally mounted to hood lifting arm 250, by suitable means, for example, a clevis and pin. Lifting arm 250 is affixed to the back wall 191 of hood 190 by bolts 251.

Hood 190 is slideably moveable in the vertical plane along rails 200 and 201 by the action of cylinder 210. In this manner, hood 190 can be moved from a position above and in contact with shipping case upper flaps 25 to a position providing clearance between the shipping case walls and the hood lower extremities at least equal to the height of the stack of box blanks when raised to a position clear of the shipping case walls by the lifting bars 164.

Base plate 194 carries a cutting device 230 and a pair of suction cups 240 on the side disposed towards shipping case support plate 150. Holddown device 220 is carried on the upper surface of base plate 194, with the extensible holddown bars 221 of holddown device 220 projecting through holes in the base plate 194 to the underside of said plate.

Cutting device 230, shown in detail in FIG. 10, is comprised of a V-shaped blade 231 carried on an arm 232 which passes through a slot 233 in base plate 194, arm 232 slideably engaged with rail 234 mounted on the underside of base plate 194. The vertical portion of arm 232 immediately above blade 23 is sharpened to form a knife to cut the adhesive tape 30 of shipping case 20. The upper end of cutting blade arm 232 includes a collar 235, which slides along the outside of rodless pneumatic cylinder 236. Rodless pneumatic cylinder 236 is a conventional device comprising a magnet enclosed in a tube magnetically coupled with a collar that slides along the exterior of the tube, wherein a differential pressure created in the interior of the tube on either end of the magnet causes the magnet to traverse the length of the tube, carrying the magnetically coupled collar with it.

Referring still to FIG. 9, holddown device 220 comprises two bars 221 which pass through base plate 194 and actuating mechanism 222, for example solenoids or pneumatic cylinders, mounted on the upper surface of base plate 194 by support member 223.

As shown in FIG. 8, a pair of suction cups 240 is carried on the underside of base plate 194. A conventional vacuum source, not shown, is used to create suction in cups 240 when the cups are placed in contact with shipping case upper flaps 25. Suction cups 240 are used to create an upward bulge in upper flaps 25, so that blade 231 and knife 232 can sever adhesive tape 30 holding the upper flaps 25 of the shipping case 20 closed. Blade 231 and knife 232 cut only the adhesive tape 30 holding shipping case upper flaps 25 in place, they do not cut shipping case 20 itself.

A plurality of suction cups 241 carried on telescoping tubes 242 are mounted on the underside of hood 190. Conventional pneumatic cylinders (not shown) extend tubes 242, bringing suction cups 241 in contact with shipping case upper insert 60 (as shown in FIG. 3). Simultaneously, a plurality of box blank holddown bars 243 are lowered so that bars 243 extend through the holes in upper insert 60 and contact the tops of box blank stacks 70. A conventional vacuum source induces suction cups 241 to engage upper insert 60, whereupon tubes 242 are retracted to lift the insert from shipping case 20. Box blank holddown bars 243 are then retracted, and hood 190 is raised. This sequence of operation allows removal of the upper shipping case insert while preserving the integrity of the box blank stacks. When the last stack of box blanks 70 has been removed from shipping case 20, hood 190 is again lowered atop of the empty shipping case. Telescoping tubes 242 are then extended, urging insert 60 inside the emptied shipping case, while the vacuum in suction cups 241 is discontinued.

Operation of the Machine

The sequence by which a shipping case containing stacks of box blanks positioned within the box blank handling machine is unloaded is now described. The sequence begins with placement of a shipping case 20 on support plate 150. Gates 180 and 181 are urged against the sides of the shipping case by the packaging machine operator, and locking pins 182, 183 are engaged in holes in support plate 150. Hood 190 is slideably lowered into a position adjacent to and in contact with the shipping case upper flaps 25 by retraction of cylinder 210. Shipping case holddown bars 221 are extended into shipping case 20 through the precut holes or star-cuts 40 in shipping case upper flaps 25 to bear against upper insert 60. A vacuum is induced in suction cups 240, causing upper flaps 25 of shipping case 20 to bulge upward, thereby presenting the adhesive tape 30 used to secure upper flaps 25 of shipping case 20 to blade 231 and knife 232 without interference by shipping case upper flaps 25. Rodless cylinder 235 is actuated, impelling knife 232 and blade 231 across the top of shipping case 20, thereby cutting upper flaps 25 open. As cutting blade 231 severs adhesive tape 30 and approaches holddown bars 221, pneumatic cylinders 222 causing the extension of bars 221 are deactivated, allowing holddown bars 221 to retract so that cutting blade 231 passes beneath them. The vacuum in suction cups 240 is discontinued and hood 190 is raised, permitting the operator to manually open the upper flaps of the shipping case, exposing upper insert 60.

Hood 190 is again lowered onto shipping case 20. Telescoping tubes 242 and box blank holddown bars 243 are extended, and vacuum is drawn in suction cups 241, engaging upper insert 60. Telescoping tubes 242 are then retracted, lifting upper insert 60 from atop the stacks of box blanks. The box blank holddown bars 243 are then retracted and hood 190 is raised to its uppermost position by the extension of cylinder 210. When hood 190 is raised, upper insert 60 remains engaged by suction cups 241. The tops of the stacks of box blanks 70 are thereby exposed for subsequent handling operations.

Next, lifting bar carriage assembly 160 is moved upwards through shipping case horizontal support plate 150 by the retraction of the piston of cylinder 170. Lifting bars 164 pass through holes 151 in support plate 150, enter the bottom of the shipping case 20 through the precut holes or star-cuts 40, and pass through holes 61 provided therefor in lower insert 60. Continued retraction of hydraulic cylinder 170 drives lifting bars 164 through the interior of shipping case 20, raising stack of box blanks 70 located thereon to a height greater than the walls of shipping case 20, thereby making stack of box blanks 70 easily accessible to the packaging machine operator, as shown in FIG. 11.

The sequence described above is repeated with each stack of box blanks 70 contained in shipping case 20. When the last stack of box blanks has been removed from lifting bars 164, and lifting bar carriage assembly 160 lowered to its bottom-most position, hood 190 is lowered onto the top of shipping case 20, and telescoping tubes 242 of suction cups 241 are extended, urging upper insert 60 into the emptied shipping case. The vacuum in suction cups 241 is discontinued, and hood 190 raised. Locking devices 182 and 183 are then disengaged and gates 180 and 181 opened, so that the emptied shipping case can be discarded by the packaging machine operator.

Although a preferred embodiment of the invention has hereinbefore been described, the scope of the invention is to be determined by the claims appended hereto.

What is claimed is:

1. In combination, a shipping case and shipping case insert for restraining a stack of box blanks, in said shipping case, said combination comprising:

a shipping case having sidewalls, lower flaps and a plurality of apertures arranged in rows and columns in said lower flaps; and a shipping case insert comprising:

a) a substantially rigid rectangular panel having a pair of side edges and a plurality of holes arranged in rows and columns therein;

b) a plurality of long tabs projecting from said side edges of said rectangular panel, said long tabs being bendable out of the plane of said rectangular panel to positions substantially perpendicular to said rectangular panel, said long tabs for engaging said stack of box blanks; and c) a plurality of short tabs projecting from said side edges of said rectangular panel interposed between said long tabs, said short tabs contacting said sidewalls of said shipping case when said shipping case insert is inserted in said shipping case, so that said plurality of holes arranged in rows and columns in said rectangular panel are in alignment with said plurality of apertures arranged in rows and columns in said lower flaps.

2. The combination as defined in claim 1 for use with an automated unloading machine, said shipping case insert for being positioned atop a stack of box blanks and for being compressed against said stack of box blanks to be located thereunder.

3. The combination as defined in claim 1 for use with an automated unloading machine, said shipping case insert for being positioned beneath a stack of box blanks, said plurality of holes in said shipping case insert for permitting said stack of box blanks to be lifted out of said shipping case.

4. In combination, a shipping case, an upper shipping case insert and a lower shipping case insert, said combination for use with an automated unloading machine, said combination comprising:

a shipping case comprising a pair of sidewalls;

a pair of endwalls, each of said endwalls joined to each one of said pair of sidewalls to form a box;

a pair of upper flaps hingedly joined to said sidewalls, said upper flaps having apertures;

a pair of lower flaps hingedly joined to said sidewalls, said lower flaps having a plurality of holes arranged in rows therein, said apertures in said upper flaps positioned so that when said upper flaps and said lower flaps are folded to close said shipping case, said apertures are not in registration with said plurality of holes in said lower flaps; and an upper shipping case insert for being positioned atop a stack of box blanks, said upper shipping case insert comprising:

a substantially rigid panel having a pair of side edges and a plurality of holes arranged in rows therein;

a plurality of long tabs projecting from said side edges of said panel, said long tabs being bendable out of the plane of said panel to positions substantially perpendicular to said panel, said long tabs for engaging said stack of box blanks; and a plurality of short tabs projecting from said side edges of said panel interposed between said long tabs, said short tabs contacting said sidewalls of said shipping case when said upper shipping case insert is inserted in said shipping case, so that said plurality of holes in said panel are in alignment with said plurality of holes in said lower flaps;

a lower shipping case insert for being positioned beneath said stack of box blanks, said lower shipping case insert comprising:

a substantially rigid panel having a pair of side edges and a plurality of holes arranged in rows therein, a plurality of long tabs projecting from said side edges of said panel, said long tabs being bendable out of the plane of said panel to positions substantially perpendicular to said panel, said long tabs for engaging said stack of box blanks; and a plurality of short tabs projecting from said side edges of said panel interposed between said long tabs, said short tabs contacting said sidewalls of said shipping case when said lower shipping case insert is inserted in said shipping case, so that said plurality of holes in said panel are in alignment with said plurality of holes in said lower flaps.

* * * * *